United States Patent [19]

Maclay

[11] 4,237,756

[45] Dec. 9, 1980

[54] ADJUSTABLE WRENCH

[76] Inventor: G. Jordan Maclay, 939 W. Armitage, Chicago, Ill. 60614

[21] Appl. No.: 956,871

[22] Filed: Nov. 1, 1978

Related U.S. Application Data

[63] Continuation of Ser. No. 853,985, Nov. 23, 1977, abandoned, which is a continuation of Ser. No. 731,297, Oct. 12, 1976, abandoned.

[51] Int. Cl.[3] ..... B25B 13/58

[52] U.S. Cl. ..... 81/185; 81/125.1

[58] Field of Search ..... 81/179, 185, DIG. 11

[56] References Cited

U.S. PATENT DOCUMENTS

| | | | |
|---|---|---|---|
| 2,910,902 | 11/1959 | Akers | 81/179 |
| 3,738,203 | 6/1973 | Cudd | 81/185 |
| 3,858,468 | 1/1975 | Pasbrig | 81/185 |

FOREIGN PATENT DOCUMENTS

| | | | |
|---|---|---|---|
| 13897 | of 1893 | United Kingdom | 81/185 |
| 12331 | of 1896 | United Kingdom | 81/185 |

*Primary Examiner*—James G. Smith
*Attorney, Agent, or Firm*—Thomas R. Vigil

[57] ABSTRACT

An open-ended wrench is provided in which the jaw and handle are formed as a unitary member with the jaw being offset with respect to the handle. A plurality of shims are longitudinally slidable from a location outside of the jaw to a location inside of the jaw to vary the dimension of the nut-receiving opening defined by the jaw. Interlocking means are provided to prevent one or more of the shims from being located inside the jaw opening unless there is supportive contact with the jaw.

6 Claims, 8 Drawing Figures

FIG. 5
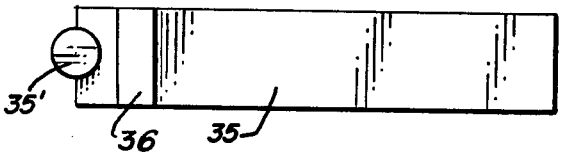
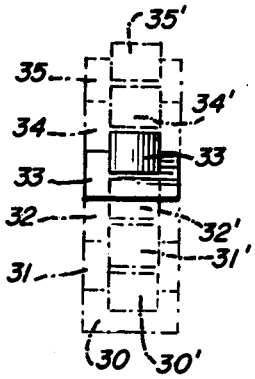
FIG. 6
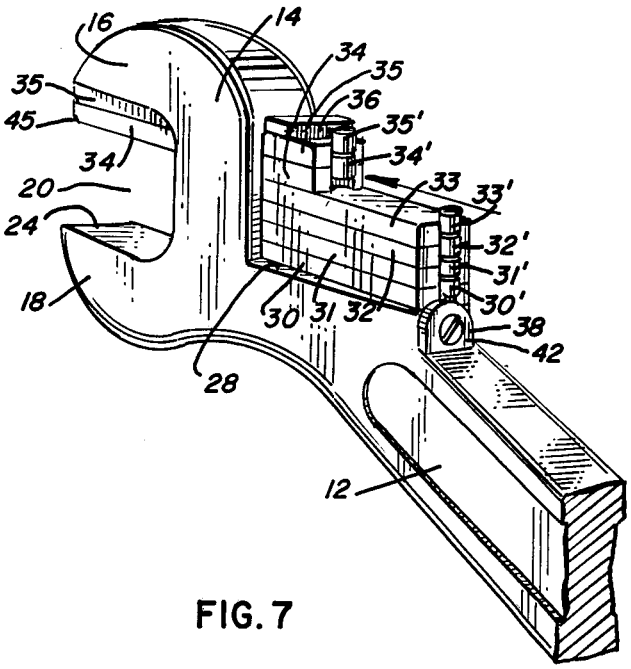
FIG. 7
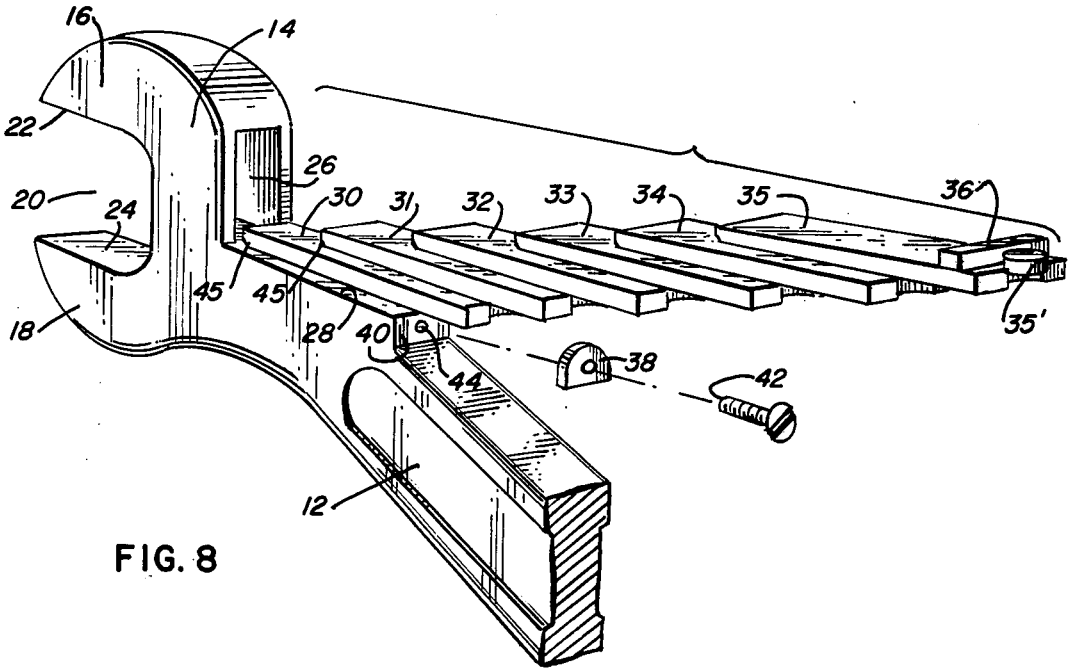
FIG. 8

ADJUSTABLE WRENCH

This is a continuation of application Ser. No. 853,985 filed on Nov. 23, 1977 which is a continuation of application Ser. No. 731,297 filed on Oct. 12, 1976, now abandoned.

BACKGROUND OF THE INVENTION

This invention relates to an improved adjustable open-ended wrench.

One very common hardware item is the adjustable wrench in which an open-ended wrench has jaws with one of the jaws being movable toward the other jaw by rotating a thumbwheel. Another common tool serving a similar purpose is the wrench set, which includes a number of wrenches each having jaws of different dimensions. These tools typically allow an operator to loosen or tighten nuts of different sizes.

However, adjustable wrenches of the type having a rotatable thumb mechanism typically have a tendency to slip under load, particularly when the threaded mechanism becomes dirty and the wrench then becomes difficult to adjust. Slippage of such adjustable wrenches may result in damage to the nuts and bolts and possible injury to the operator.

The difficulty in using a number of wrenches of fixed dimension is apparent, in that it requires additional trouble to look through a set of wrenches to find the proper wrench to fit a particular nut. Often it is more convenient to simply use an adjustable wrench which has the difficulties mentioned above.

Many persons have attempted to design wrenches which can be adjusted to fit nuts of different sizes, but which do not require a thumb rotating mechanism. However, these variable wrenches typically have disadvantages which have prevented them from becoming popular in hardware stores.

For example, one type of prior art wrench has variable blades which may swing into place to vary the spacing between the jaws. Such a wrench is illustrated in U.S. Pat. Nos. 1,080,064, 1,399,966, 1,550,564 and 1,646,140. Among other things, the type of wrench having rotatable blades requires special provision for alignment of blades. Further, it may be possible to rotate one of the middle blades into the jaws without rotating other supportive blades and in this manner, damage to the blades may readily occur. Another type of adjustable wrench that has been designed in the prior art is a type in which a shim located adjacent each jaw can be slid into position to decrease the spacing between the jaws. This type of wrench is illustrated in U.S. Pat. Nos. 2,803,158, 2,900,857 and 3,738,203. One apparent disadvantage of this type of wrench is that there are only two usable shims with respect to each jaw opening and thus this type of wrench lacks the adjustability and versatility of other types of adjustable wrenches.

Another type of adjustable wrench is illustrated in U.S. Pat. No. 3,802,303. This type of adjustable wrench uses metallic inserts of prescribed dimensions which serve to vary the dimension of the jaw opening of the wrench. It is possible, however, that one or more of these metallic inserts may be lost because they are not a connected portion of the wrench itself. Further, by utilizing such inserts the wrench is unable to sustain the types of loads sustained by some other adjustable wrenches.

U.S. Pat. Nos. 1,204,433 and 1,529,605 show other types of adjustable wrenches, which are unduly complicated to manufacture and are believed not to be economically feasible.

An adjustable wrench using longitudinally slidable shims has been considered in U.S. Pat. Nos. 562,709 and 2,596,882. The wrench of U.S. Pat. No. 562,709 appears disadvantageous, however, because the shims are held in place by springs and metal straps which weakens the system, the shims are relatively difficult to operate because they are not thumb operated, the relationship between the open-ended jaw and the handle is simplistic and not of utmost efficiency and one or more of the shims may be moved into the jaw opening without supportive contact against one of the jaws. Likewise, the wrench of U.S. Pat. No. 2,596,882 appears difficult to manufacture and requires shims which are different from each other. Since the shims project beyond the upper jaw in the U.S. Pat. No. 2,596,882 construction, the shims may be deformed under load.

It is, therefore, an object of the present invention to provide an adjustable wrench which alleviates the difficulties concomitant with prior art adjustable wrenches.

BRIEF DESCRIPTION OF THE INVENTION

In accordance with the present invention, an open-ended wrench is provided of the type including a manually-graspable handle and a nut-seizing jaw connected to the handle. The jaw comprises an upper jaw and a lower jaw spaced a fixed distance from each other to define an opening for receiving a nut. A slot communicates with the opening and extends through the jaw and a plurality of shims are longitudinally slidable through the slot from a location outside of the opening to a location inside of the opening to provide a variable dimension for the nut-receiving opening.

In the illustrative embodiment, the jaw is offset at an angle with respect to the handle and the handle and jaw are formed as a unitary integral member.

In the illustrative embodiment, the handle includes a shelf portion adjacent the jaw for supporting a plurality of shims. Means are provided for permitting simple removal of the shims for cleaning and/or replacement.

In the illustrative embodiment, the shims are dimensioned for ease in sliding action by the finger of an operator. Further, interlock means are provided for preventing any shim from being located inside of the opening unless there is supportive contact with the jaw.

In the illustrative embodiment, the interlock means comprise a lug carried by the shims with the lug being engageable with a portion of the adjacent shim that is located toward the supportive jaw. The shims are dimensioned so that when they are in their extended position inside of the opening, the distal ends of the shims will be aligned vertically.

A more detailed explanation of the invention is provided in the following description and claims, and is illustrated in the accompanying drawings.

BRIEF DESCRIPTION OF THE DRAWINGS

FIG. 5 is a top plan view of a shim;

FIG. 6 is an end view of the shim of FIG. 5, with other shims of a plurality of shims shown in dashed line representation;

FIG. 7 is a fragmentary perspective view of the wrench of FIG. 1; and

FIG. 8 is an exploded view of the wrench of FIG. 7.

DETAILED DESCRIPTION OF THE ILLUSTRATIVE EMBODIMENT

Figure 1:
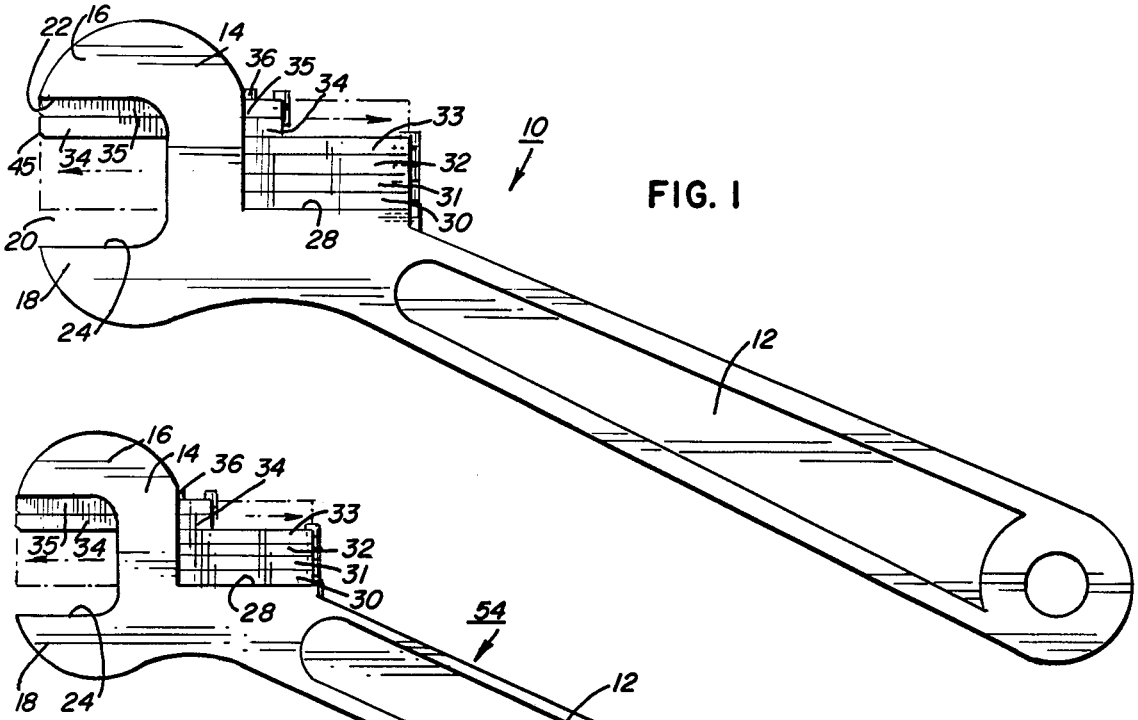
FIG. 1 is an elevational view of an adjustable wrench constructed in accordance with the principles of the present invention, with two of the plurality of shims being in their extended position within the nut-receiving opening.

Referring to the drawings, in FIGS. 1, 3, 7 and 8 an open-ended adjustable wrench 10 is shown having a manually-graspable handle 12 and a jaw 14 connected to handle 12. Preferably handle 12 and jaw 14 are forged as a unitary integral member, with jaw 14 comprising an upper jaw 16 and a lower jaw 18. A nut-receiving opening 20 is defined by upper jaw 16 and lower jaw 18. Jaw 14 is angled with respect to handle 12 to provide a more effective operation. It is preferred that the angle between the longitudinal axis of the handle and the axis of the jaw be between 15° and 45° with an optimum of approximately 22.5°.

As shown most clearly in FIG. 8, a slot 26 is defined by jaw 14 and communicates with opening 20 and extends rearwardly through the jaw. A planar shelf 28 is provided at the portion of handle 12 adjacent jaw 14 for underlying and supporting a number of generally rectilinear shims 30, 31, 32, 33, 34 and 35. Shims 30–35 are normally supported by shelf 28 with one end of the shims being located within the walls defining slot 26. Shims 30–35 may be simply moved longitudinally, by the thumb action of an operator, to a position wherein one or more of the shims is located within opening 20, to vary the dimension of the nut-receiving opening.

Thus as shown in FIGS. 1 and 7, shims 35 and 34 have been moved inwardly to decrease the nut-receiving opening.

The distal position of the shims is limited by an abutment member 36 carried by the upper surface of shim 35. Because of the interlocking system discussed below, none of the shims can move further than shim 35, which carries abutment member 36.

It is important that the shims within the nut-receiving opening be supported properly. To this end, supportive contact of the shims with upper jaw 16 is required by means of an interlocking arrangement. The interlock comprises lugs 30', 31', 32', 33', 34' and 35', carried respectively by shims 30, 31, 32, 33, 34 and 35. Each of the lugs overlies a groove for receiving the lug below it, as shown most clearly in FIGS. 7 and 8. Thus the shims must be moved sequentially into position within the nut-receiving opening. In other words, shim 34 cannot be moved into opening 20 without also moving shim 35, thereby providing supportive contact for shim 34. Likewise, shim 33 cannot be moved into opening 20 without also moving shims 34 and 35 into the opening. Further, shims 32 cannot be moved into opening 20 without also moving shims 33, 34 and 35 into the opening. In the same manner, upper shims cannot be moved out of the opening 20 without also moving the lower shims out with them. This interlocking system prevents one of the intermediate shims (30–34) from being located within opening 20 without supportive contact between that shim and jaw 16. Further, the interlock very easily enables the operator to retract several of the shims from the nut-receiving opening 20, by merely pulling lug 35' backwardly.

A stop member 38 is fastened to end 40 of shoulder 28 by means of a bolt 42 threadedly received by threaded opening 44, as shown most clearly in FIGS. 7 and 8. Member 38 will prevent the shims 30–35 from moving further backward than a predetermined amount. If desired, the shims can be easily removed for alteration and/or cleaning by merely unscrewing bolt 42 and removing member 38 from end 40.

Each of the shims has a bevel 45 at its distal end opposite the interlocking lug, in order to enable the shim to grasp the nut very easily.

The opening 20 between surfaces 22 and 24 may have a dimension of one inch, for example. Each of the shims would preferably have a dimension corresponding to nut dimension variations. Thus each of the shims may be 1/16 inch thick, for example, to provide an adjustable wrench having the capability of operating with nuts of 1 inch diameter, 15/16 inch diameter, ⅞ inch diameter, 13/16 inch diameter, ¾ inch diameter, 11/16 inch diameter and ⅝ inch diameter. Other dimensions may be used, if desired, to give different variations, as there is no limitation with respect to particular dimensions used in the present invention.

Figure 4:
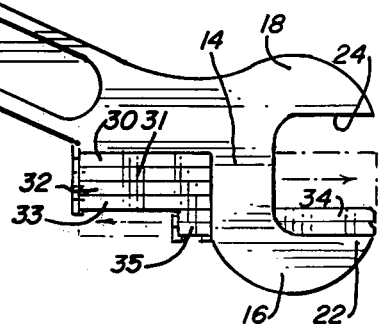
FIG. 4 is a fragmentary enlarged view of a modified embodiment of the invention, in which a spring is utilized, and is shown partially broken for clarity.
Figure 4:
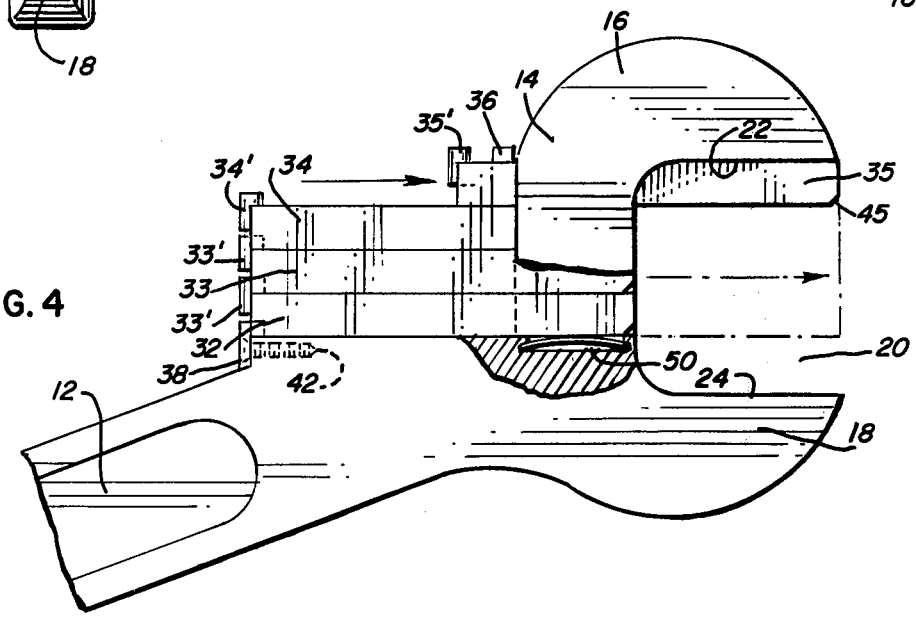

When one or more of the shims is in its extended position in opening 20 and a wrench grasps a nut, the nut-tightening or nut-loosening forces will urge the shims tightly against jaw 16 and each other to maintain the shims in place within opening 20. If desired, additional means may be used to hold the shims in place, for example, compression of the shims may be provided by using a spring. As shown in FIG. 4, spring 50 is located within jaw 14 to compress the shims upwardly. Alternatively, a detent system may be employed.

Figure 2:
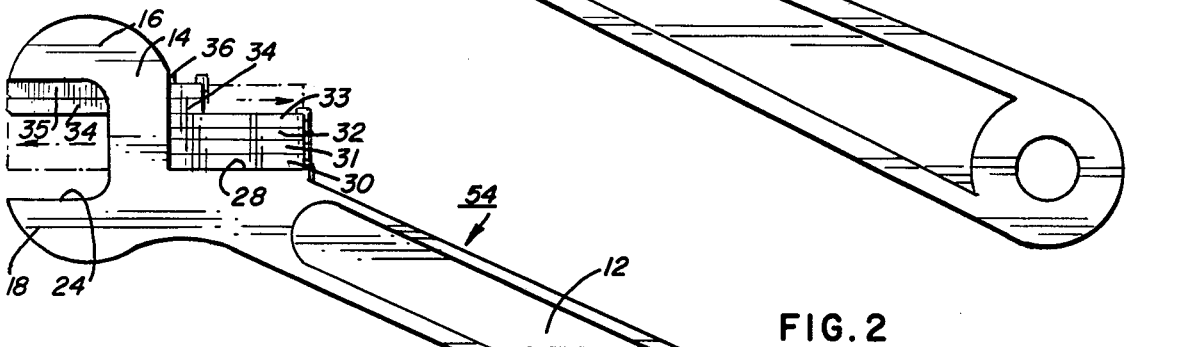
FIG. 2 is a double-ended wrench constructed in accordance with the principles of the present invention.
Figure 3:
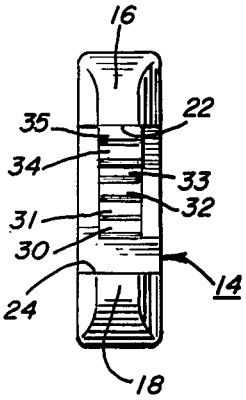
FIG. 3 is an end view of the wrench of FIG. 1.

If desired, the invention could be utilized in connection with a double-ended wrench as illustrated in FIG. 2. The structural details set forth above with respect to the single-ended wrench 10 are applicable to the double-ended wrench 54 of FIG. 2. Identical reference numerals have been used to designate identical parts with respect to the various embodiments of the invention.

Although two embodiments of the invention have been shown and described, it is to be understood that various modifications and substitutions may be made by those skilled in the art without departing from the novel spirit and scope of the present invention. For example, among other things, one or more shims may be placed adjacent the lower jaw 18 instead of or in addition to the shims located adjacent the upper jaw 16.

What is claimed is:

1. In an open-ended wrench of the type including a manually-graspable handle and a nut-seizing jaw connected to the handle, the improvement comprising, in combination:

said jaw comprising an upper jaw and a lower jaw spaced a fixed distance from each other to define an opening for receiving a nut, and a slot communicating with said opening and extending through said jaw;

a plurality of equal size shims longitudinally slidable through said slot from a location outside of said opening to a location inside of said opening to provide a variable dimension for said nut-receiving opening;

said handle including a shelf portion adjacent said jaws for supporting said plurality of equal size shims;

said plurality of equal size shims comprising interlock means for preventing any shim from being located inside of said opening unless there is supportive contact with said jaw; said interlock means comprising equal size lugs carried by said shims, and each of said shims defining a groove for receiving the lug of an underlying shim;

said plurality of equal size shims being positioned for sequentially varying said nut-receiving opening dimension by longitudinally moving said shims into said opening with said shims that are moved into said opening being in supportive contact with said jaw;

an abutment means carried by the top shim adjacent to and spaced from said lug on said top shim to prevent the shims from sliding further than a predetermined distance and to provide a space between said lug on said top shim and said jaw when the shims are slid inside said opening.

2. A wrench as described in claim 1, in which the distal ends of said shims are beveled for ease in grasping a nut.

3. A wrench as described in claim 1, in which said wrench is double-ended, having similarly configurated jaws on each end of the handle.

4. A wrench as described in claim 1, in which there are detent means for compressing said shims against said jaw for aiding in holding the shims in place.

5. A wrench as described in claim 4, in which the distal ends of said shims are beveled for ease in grasping a nut.

6. A wrench as described in claim 4, in which said wrench is double-ended, having similarly configurated jaws on each end of the handle.

* * * * *